US010680381B2

(12) United States Patent
Hagmann et al.

(10) Patent No.: US 10,680,381 B2
(45) Date of Patent: Jun. 9, 2020

(54) RETAINING DEVICE FOR RETAINING A NUMBER OF PLUGS

(71) Applicant: ITT MANUFACTURING ENTERPRISES, LLC, Wilmington, DE (US)

(72) Inventors: Bernd Hagmann, Bad Ueberkingen (DE); Stefan Mayer, Waiblingen (DE)

(73) Assignee: ITT MANUFACTURING ENTERPRISES, LLC, Wilmington, DE (US)

( * ) Notice: Subject to any disclaimer, the term of this patent is extended or adjusted under 35 U.S.C. 154(b) by 0 days.

(21) Appl. No.: 15/561,023

(22) PCT Filed: Mar. 23, 2016

(86) PCT No.: PCT/IB2016/000345
§ 371 (c)(1),
(2) Date: Sep. 22, 2017

(87) PCT Pub. No.: WO2016/151391
PCT Pub. Date: Sep. 29, 2016

(65) Prior Publication Data

US 2018/0054018 A1 Feb. 22, 2018

(30) Foreign Application Priority Data

Mar. 24, 2015 (DE) ..... 10 2015 205 363

(51) Int. Cl.
*H01R 13/518* (2006.01)
*H01R 13/74* (2006.01)
*H01R 13/00* (2006.01)

(52) U.S. Cl.
CPC ..... *H01R 13/518* (2013.01); *H01R 13/748* (2013.01); *H01R 13/005* (2013.01)

(58) Field of Classification Search
CPC .. H01R 13/518; H01R 13/514; H01R 13/506; H01R 13/748; H01R 13/005
(Continued)

(56) References Cited

U.S. PATENT DOCUMENTS 6,273,752 B1 * 8/2001 Martin ..... G02B 6/3897 439/540.1
6,821,160 B2 * 11/2004 Fink ..... H01R 13/512 439/595

(Continued)

FOREIGN PATENT DOCUMENTS

DE 20 2005 003 124 7/2006
DE 10 2008 038 588 2/2010

(Continued)

OTHER PUBLICATIONS

PCT/IB2016/000345 International Search Report and Written Opinion dated Jun. 21, 2016 in 12 pages.

*Primary Examiner* — Gary F Paumen
(74) *Attorney, Agent, or Firm* — Knobbe Martens Olson & Bear LLP

(57) ABSTRACT

Disclosed is a retaining device for retaining a number of plugs and for arranging on a wall passage. In some embodiments, the retaining device comprises a number of substantially identically sized through-holes. In some embodiments, a modular element comprises an outer interface region for receiving the modular element in one of the through-holes. In some embodiments, the modular element comprises an inner interface region for receiving one of the plugs in the modular element.

22 Claims, 7 Drawing Sheets

(58) Field of Classification Search
USPC ..... 439/540.1, 701
See application file for complete search history.

(56) References Cited

U.S. PATENT DOCUMENTS

| | | | | |
|---|---|---|---|---|
| 7,850,469 | B2 * | 12/2010 | Kobayashi | H01R 13/443<br>439/148 |
| 8,096,827 | B2 * | 1/2012 | Kleinkorres | H01R 13/745<br>439/540.1 |
| 8,668,530 | B2 * | 3/2014 | Riepe | H01R 13/518<br>439/532 |
| 2003/0036316 | A1 * | 2/2003 | Fujita | H01R 13/518<br>439/701 |
| 2011/0165798 | A1 * | 7/2011 | Derks | H01R 13/514<br>439/677 |

FOREIGN PATENT DOCUMENTS

| | | |
|---|---|---|
| DE | 10 2010 050 350 | 5/2012 |
| DE | 10 2011 006 534 | 10/2012 |
| DE | 10 2006 015718 | 10/2017 |
| EP | 1 703 595 | 9/2006 |
| WO | WO 2016/151391 A1 | 9/2016 |

* cited by examiner

RETAINING DEVICE FOR RETAINING A NUMBER OF PLUGS

CROSS REFERENCE

This application is a U.S. National Phase of PCT International Application No. PCT/IB2016/000345, filed Mar. 23, 2016 and published as WO 2016/151391 on Sep. 29, 2016, which claims priority to German Application No. 102015205363.6, filed Mar. 24, 2015. The entire disclosure of each of the above-identified applications is hereby incorporated by reference.

BACKGROUND

Field

The disclosure concerns a retaining device for retaining a number of plugs.

Certain Related Art

It is known that plugs in a wall opening are, for example, mounted with a screwed-on flange. It is known that a number of plugs can be secured to the same wall opening using a mounting plate.

DE 10 2008 038 588 A1 discloses a distribution arrangement for electrical leads. The distribution arrangement consists of a casing exhibiting a main shell and cover shell. The cover shell is equipped with slots. An individually created and/or oriented socket is fitted in each slot.

SUMMARY OF CERTAIN FEATURES

A retaining device for retaining a number of plugs and for arrangement on a wall opening is proposed. Due to the fact that the retaining device contains a number of essentially equally-dimensioned through-holes, an exchange of plugs can be implemented. Because a modular element contains an outer interface area for the entry of the modular element in one of the through-holes, and the modular element contains an inner interface area for the entry of one of the plugs in the modular element, the interchangeability of plugs requires nothing more to be guaranteed. In particular, a position, orientation, and the number of contacts can be matched to the customer's requirements. Particularly of note is the fact that subsequent changes are thereby possible.

Due to the fact that a first inner interface area of a first modular element and a second inner interface area of a second modular element differ from each other due to mounting method and/or diameter, an advantageous modularity is created which allows the arrangement of a variety of different plugs.

In an advantageous embodiment, a third closed modular element is provided for closing one of the through-holes. The third closed modular element is thus inserted in the form of a place-holder for modifications and expansions, so that it advantageously remains possible to enhance the flexibility of a retaining device once arranged.

In an advantageous embodiment, the through-holes and the outer interface area of the modular element corresponding to one of the through-holes are always constructed hexagonally. This hexagonal form advantageously allows for the necessary installation space to be reduced and, simultaneously, for the contact density to be increased across the surface of the retaining device. Furthermore, the hexagonal form achieves an encoding that limits the arrangement of the modular element to six positions. In addition to this, the hexagonal form allows round plugs to be arranged in the retaining device, wherein the plugs can best fill the space within a hexagon with their diameters.

In an advantageous embodiment, a peripheral area of the retaining device is enclosed at an obtuse angle between two neighboring through-holes. A fastening section for connecting the retaining device to the wall is arranged in the peripheral area. Advantageously, the installation space on the wall required for the retaining device is thereby further reduced and the peripheral area therefore optimally employed.

In an advantageous embodiment, a ligament between two neighboring through-holes exhibits a longitudinal axis. The fastening section is located on the longitudinal axis of the ligament, whereby a force is applied to the wall at a favorable point.

In an advantageous embodiment, the through-holes and the outer interface area of the modular element corresponding to one of the through-holes are each constructed in rectangular form. This rectangular form advantageously allows the contact density to be increased.

In an advantageous further development, the modular element can be secured to the retaining device via a slide that can be fed transversely to the longitudinal axis of the plug and engages with the outer interface area. Advantageously, the modular element can thereby be connected to the retaining device in a simple manner.

In an advantageous embodiment, two peripheral sections of neighboring through-holes essentially running parallel to one another form a common ligament. Consequently, the advantageous result is that the through-holes lie as close as possible to one another and so ensure a high contact density or a high plug density per surface of the retaining device or wall.

In an advantageous embodiment, the modular element exhibits a first coding section. One of the through-holes exhibits a second coding section. The first coding section and the second coding section advantageously correspond in such a manner that the modular element can be arranged in the through-hole only in a predetermined orientation.

Further features, application possibilities, and advantages of the disclosure arise from the following description of implementation examples of the disclosure, which are represented in the figures of the illustration. All of the features described or represented, either individually or in various combinations, form the subject matter of the disclosure, independently of their summary in the patent claims or their referents, as well as independently of their formulation or representation in the description or in the illustration. For function-equivalent sizes and features, the same reference signs are used in all figures, even in the case of different embodiments.

BRIEF DESCRIPTION OF THE DRAWINGS

Below, exemplary embodiments of the disclosure are explained with reference to the illustration. In the illustration.

DETAILED DESCRIPTION OF CERTAIN EMBODIMENTS

Figure 1:
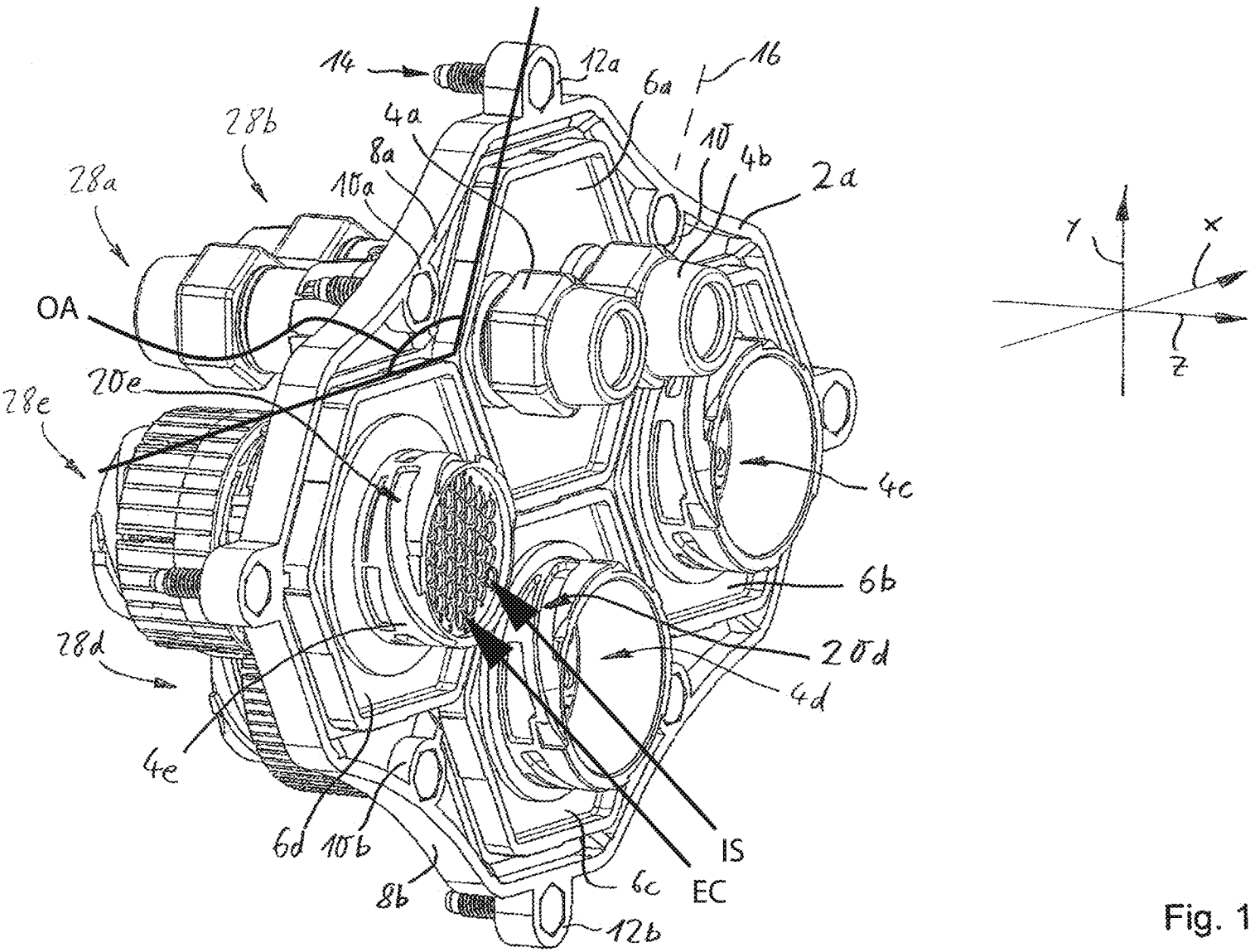
FIG. 1 displays a retaining device in schematic perspectival view.

FIG. 1 shows a retaining device 2 (also called a retaining frame or a frame) which retains a number of plugs 4 with the respective modular element 6 arranged between the plug 4 and the retaining device 2. A plug 4 contains an insulation section equipped to hold a number of electrical contacts, and, optionally, a casing section. An insulation section may contain one or several insulating bodies. The retaining device 2 exhibits a hexagonal pattern of through-holes, in which the modular elements 6 are arranged, wherein the modular elements 6 also exhibit a hexagonal form. The hexagonal form is intentionally implemented in such a way that there are rounded corners and edges of essentially the same length.

Two neighboring through-holes through the retaining device 2 include a peripheral area 8 formed including an obtuse angle OA between sides of the through-holes. In the peripheral area 8, a mounting section 10 is arranged which is equipped for the connection of the retaining device 2 to a wall. Alongside the recessed mounting sections 10, the retaining device 2 exhibits exposed mounting sections 12. A screw 14 runs through the mounting sections 10, 12, which screw enters through a mounting opening in the wall and, on the other side of the wall, leads to a wall opening for the connectors 4 with a locknut for the mounting of the retaining device 2. Furthermore, a longitudinal axis 16 of a ligament further outlined below is, as an example, shown, wherein the mounting section 10 is arranged on the extended longitudinal axis 16 of the ligament.

The connectors 4*c*, 4*d*, and 4*e* each include a connection section 20 for connection to an accessory component. A mating connector 28 corresponding to the respective connector 4 is arranged contrary to the Z-direction.

The modular element 6 can, naturally, also include a carrying body in which, instead of electrical contacts, or in addition to the electrical contacts, a pneumatic connection and/or a hydraulic connection is incorporated, retained, and led through the wall. The carrying body is thereby constructed analogously to the insulation body, but need not, however, exhibit the latter's electrically insulating effect. Advantageously, the possible applications of the retaining frame 2 are thus increased by the modular element 6.

Figure 2:
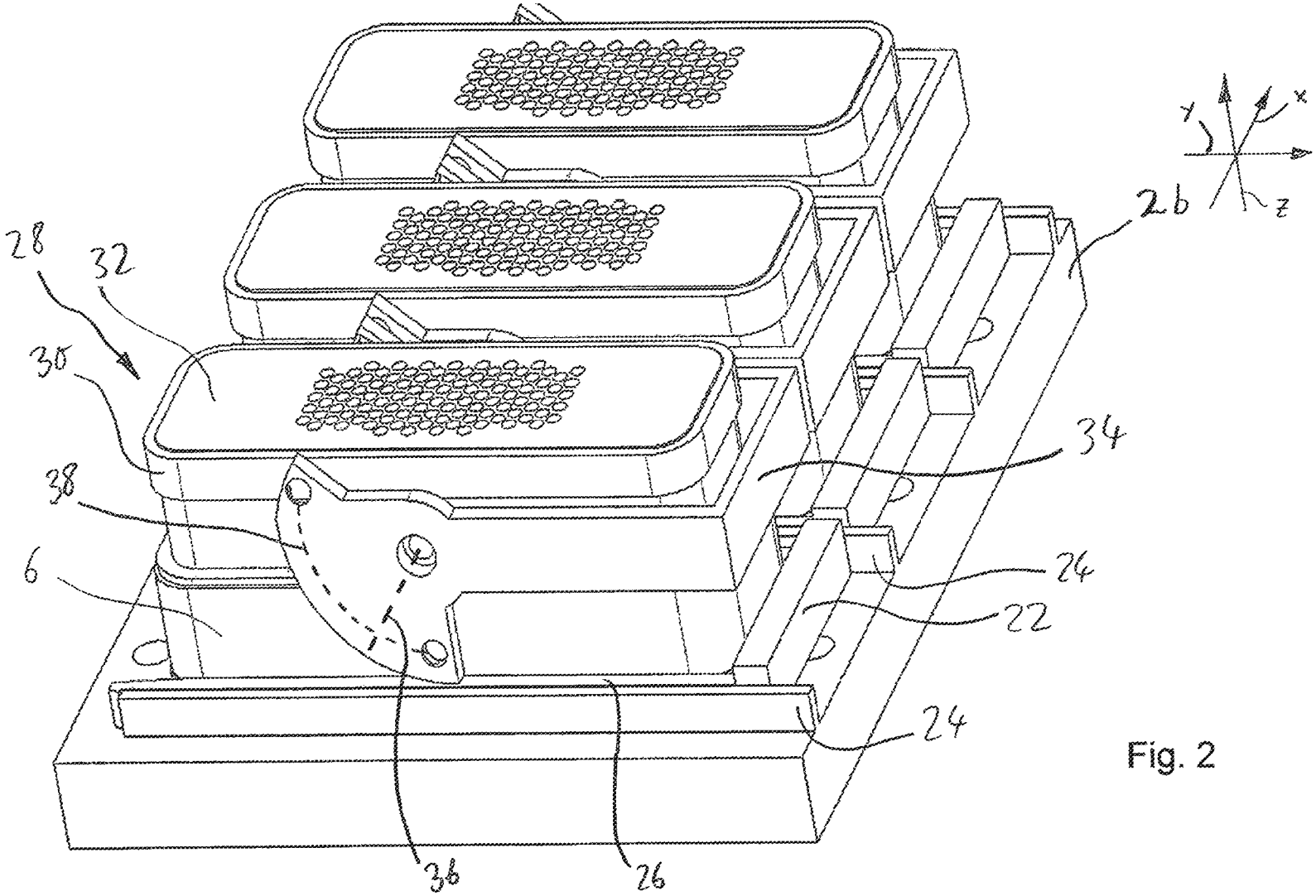
FIG. 2 displays a further retaining device in schematic perspectival view.

FIG. 2 shows, in a perspectival schematic plan, an embodiment of the retaining device 2 wherein the through-holes are essentially constructed in rectangular form. The rectangular construction of the through-holes includes a rounding of the edges. A modular element 6 is connected via a slide 22 and a ligament 24 on both sides of the module 6 to the retaining device 2, in that the slide 22 with the respective arms 26 oriented contrary to the Y-direction creates, among other things, an interlocking connection in the Z-direction between the ligaments 24 and the arm 26, as well as between the modular element 6 and the arm 26. A mating connector 28 is incorporated into the module 6. The mating connector 28 includes a casing 30 and an insulation section 32.

The insulation body of the connector 4 is arranged opposite to the Z-direction in the modular element 6; this is not visible in FIG. 2. A lever 34, which turns around an axis 36, is fitted to the casing 30, for connecting the mating connector 28 to the connector 4. The closed position is shown in FIG. 2. If the lever 34 is moved from the closed position along a bayonet-shaped rail 38 (not visible) on the inner side of the lever 34, the mating connector 28 is moved in the Z-direction, since the distance of the bayonet-shaped rail from the axis 36 is increased when the lever 34 is moved from its closed position.

Figure 3:
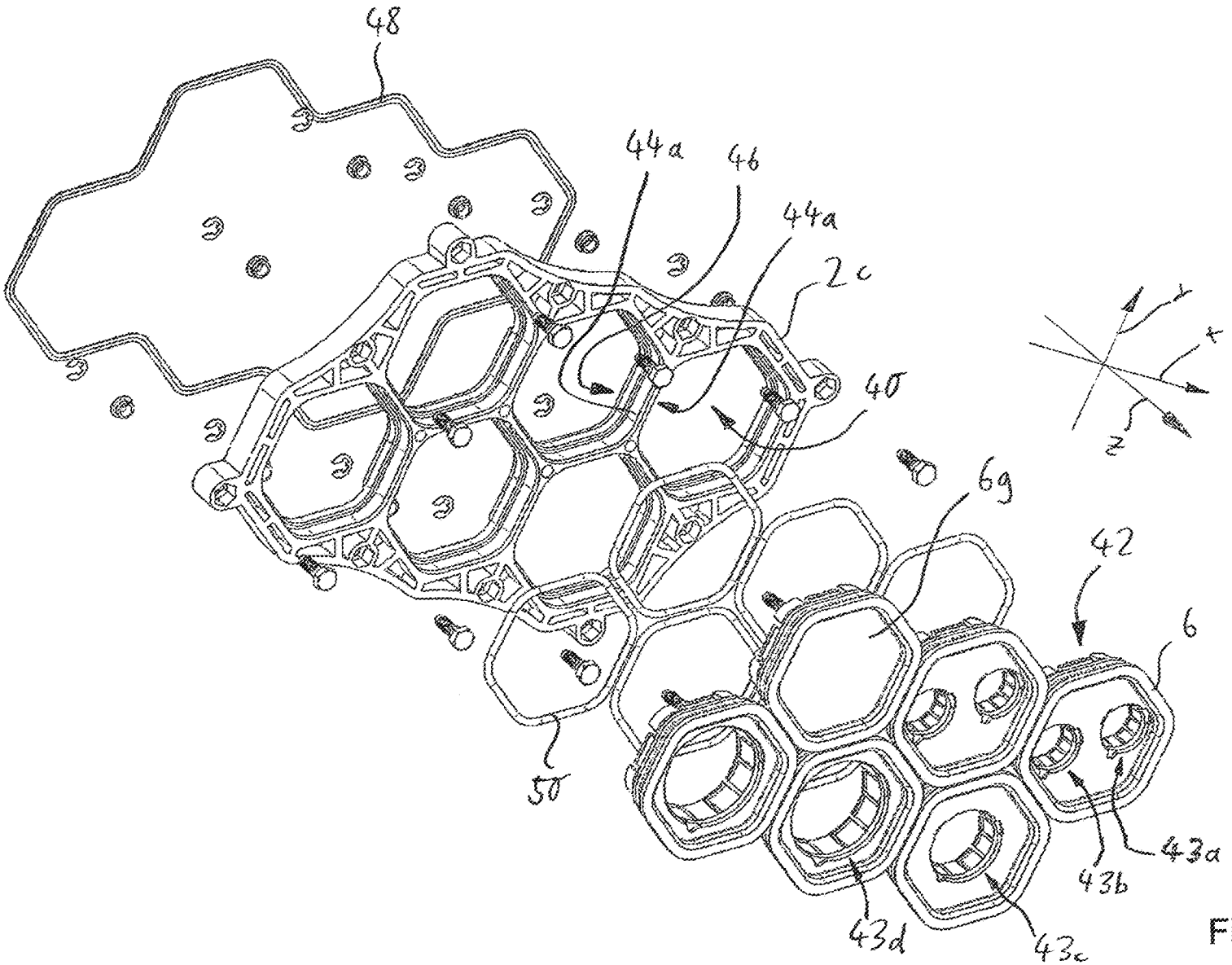
FIG. 3 displays a retaining device in a schematic exploded view.

FIG. 3 shows an exploded view of an exemplary implementation of the retaining device 2 with the related modular elements 6. As an example, a closed modular element 6*g* is displayed. The retaining device 2 exhibits six through-holes 40 (also called receiving units) of essentially equal diameters. The modular elements 6 exhibit an outer interface area 42, which is designed to engage in any of the through-holes 40. The modular element 6 exhibits one or more inner interface areas 43 for the reception of one of the plugs in the modular element 6. The respective inner interface areas 43 may differ as to mounting method and/or diameter in order to admit the relevant plugs.

Two neighboring through-holes 40 each exhibit a peripheral area 44, essentially running in parallel to one another. The two peripheral areas 44 form a ligament 46. A seal 48 can be fitted between the retaining device 2 and the edge of the wall opening. A seal 50 can be fitted between a respective one of the modular elements 6 and the retaining device 2.

Figure 4:
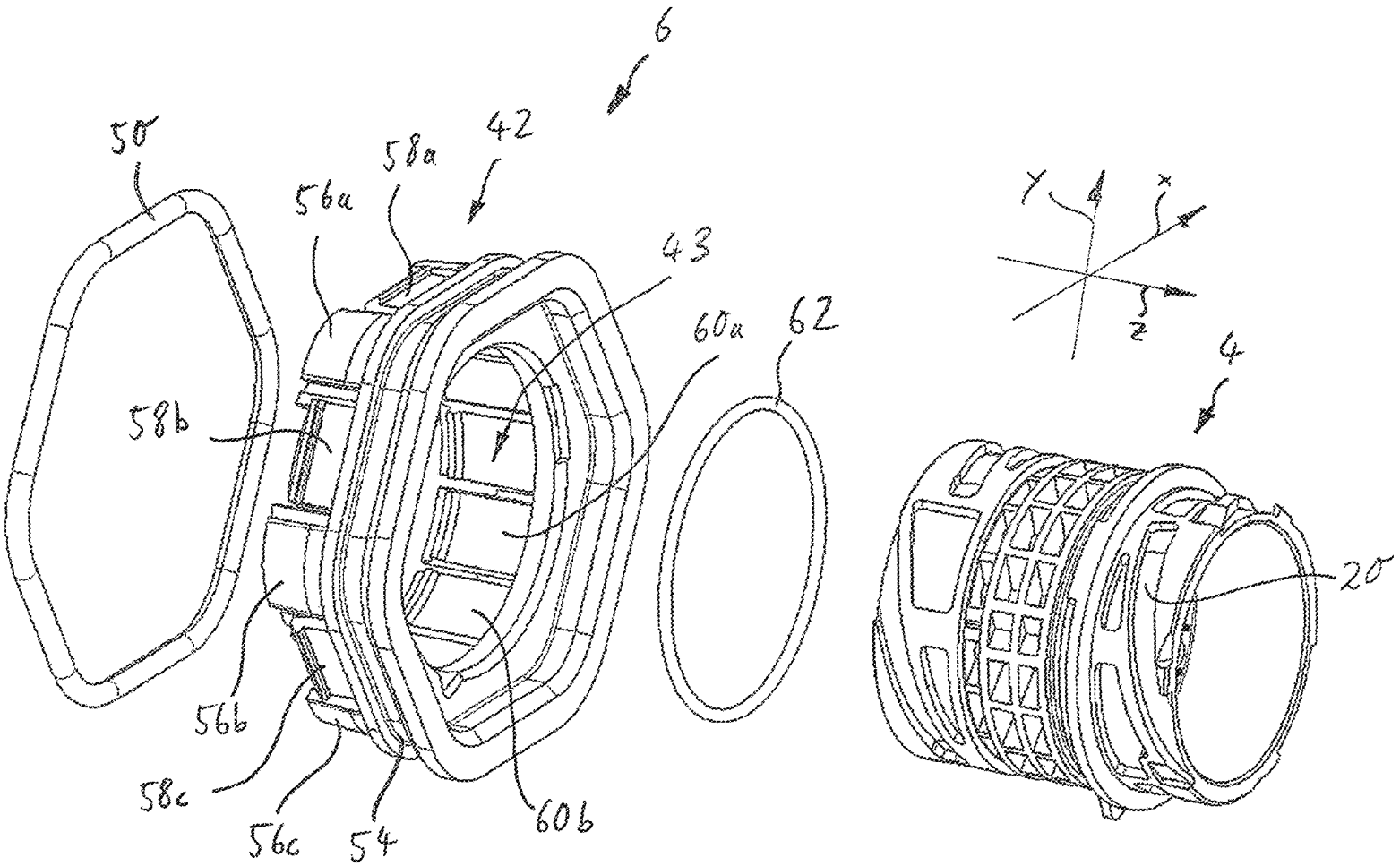
FIG. 4 displays a modular element and a plug in a schematic exploded view.

FIG. 4 shows an exploded view of a modular element 6 and an assigned connector 4. The seal 50 can be inserted into a peripheral groove 54 of the module 6 and is part of the outer interface 42. The outer interface 42 includes, furthermore, feed elements 56 fixed to the corners of the hexagonal shape and latching sections 58 stretching along the hexagon edges. The inner interface area 43 of the module 6 is formed from a number of circularly arranged latching elements 60. A further seal 62 is provided for arrangement between the interface area 43 and the connector 4.

Figure 5:
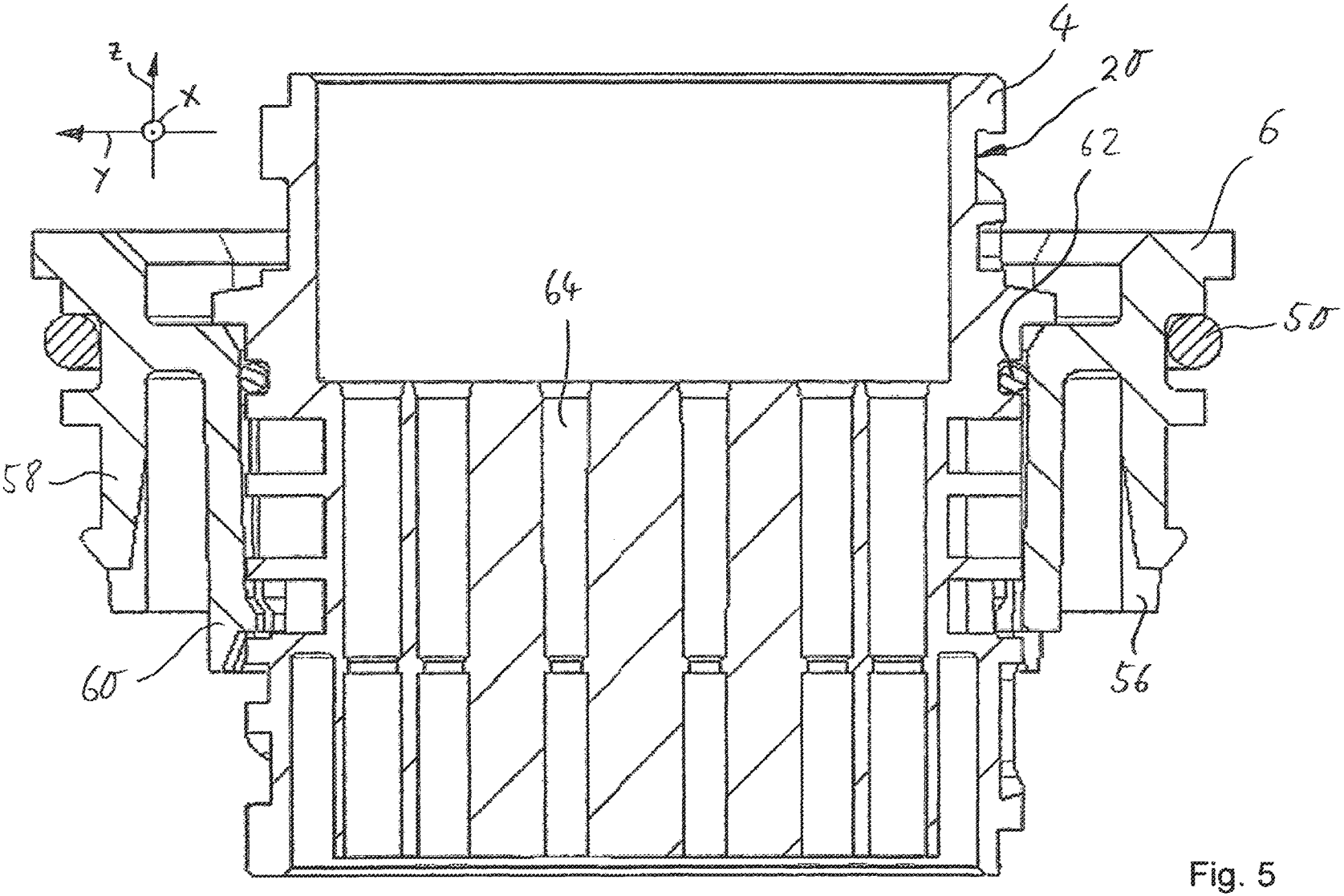
FIG. 5 displays a schematic sectional view through the modular element and plug from FIG. 4.

FIG. 5 shows a section through the assembled components from FIG. 4. The connector 4 is a single-piece construction and includes through-holes 64 for the reception of contacts.

Figure 6:
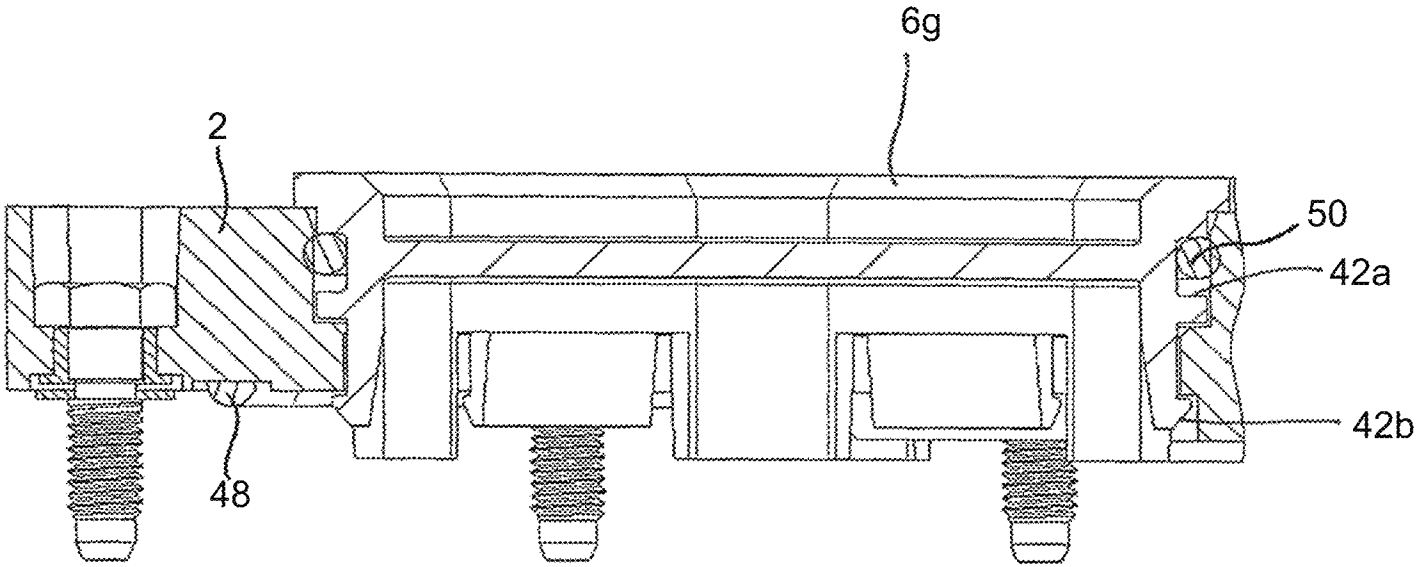
FIG. 6 displays a schematic sectional view through a closed modular element.

FIG. 6 shows, in a schematic sectional view, a section through a closed modular element 6, which is arranged in the retaining device 2. As illustrated, the modular element 6 can include a flange 42*a* and a latch 42*b*.

Figure 7:
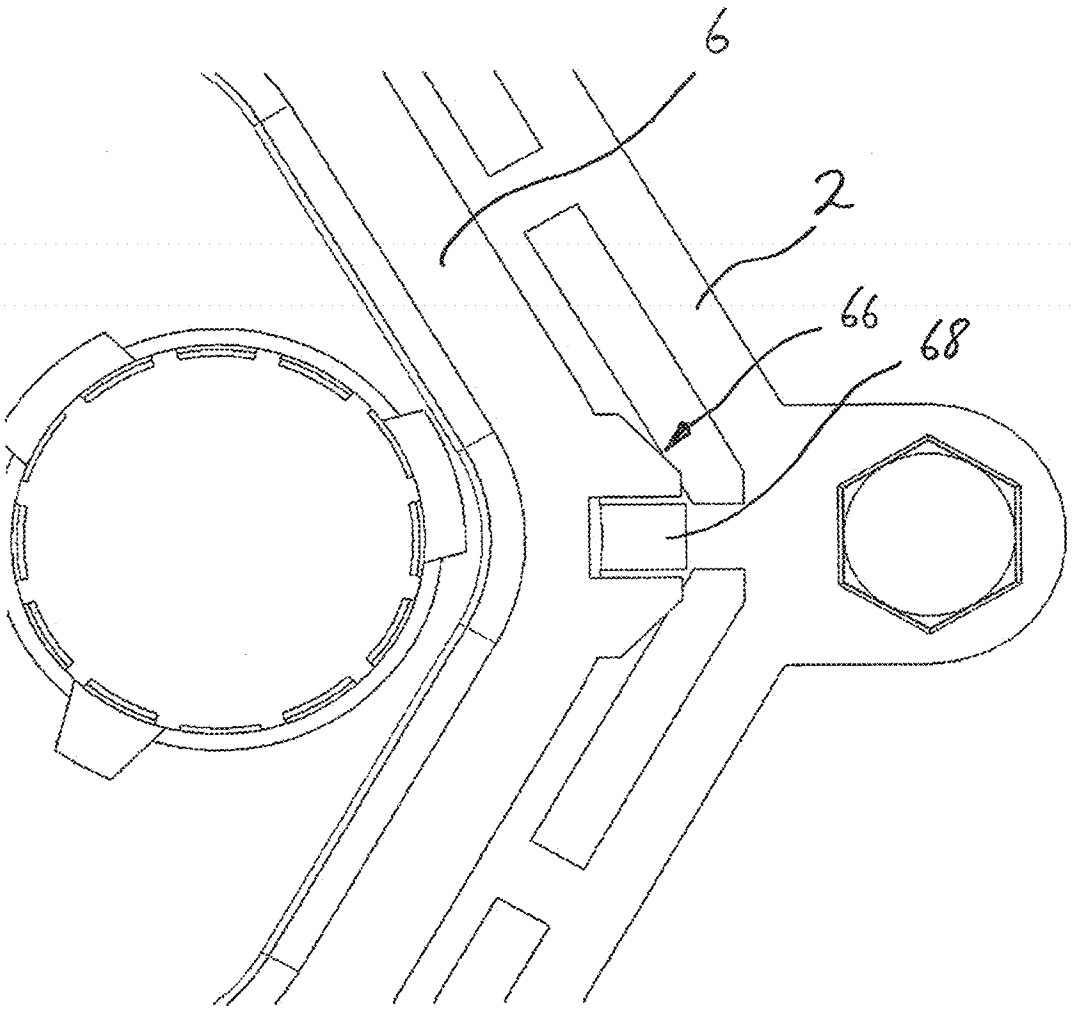
FIG. 7 displays a schematic plan of coding sections of a modular element and a retaining device.

FIG. 7 shows a schematic plan of the modular element 6 which is arranged in the retaining frame 2. The modular element 6 exhibits a first coding section 66 in the form of two protrusions which enclose a second coding section 68 fitted in the frame or the retaining device 2. The first coding section 66 is fitted to only one of the six corner areas of the hexagonal shape of the modular element 6, whereby a corner area without the coding section 66 cannot be inserted into the retaining device 2—in particular, a through-hole 40—since this is prevented by the second coding section 68.

The invention claimed is:

1. A retaining device configured to retain and arrange a plurality of connectors, each of the plurality of connectors comprising an insulating section that is configured to hold an electrical contact and that comprises an insulating body, the retaining device comprising:

a frame comprising:

a mounting section configured to connect the retaining device to a wall, the mounting section being arranged in a peripheral area of the retaining device, and a plurality of receiving units, each of the receiving units comprising a boundary wall that bounds a through-hole, the boundary wall comprising an inner wall with a step; and a plurality of modular elements, each one of the plurality of modular elements configured to be received in any of the plurality of receiving units, the modular elements each comprising:

an outer interface area having a flange and a latch, wherein the flange is integral with the outer interface area and is configured to engage with the corresponding step when one of the modular element is received in one of the plurality of receiving units, and wherein the latch is integral with the outer interface area and is configured to retain the modular element in one of the plurality of receiving units; and an inner interface area configured to receive one of the plurality of connectors in the modular element.

2. The retaining device according to claim 1, wherein the plurality of modular elements comprises a first inner interface area of a first modular element and a second inner interface area of a second modular element differ.

3. The retaining device according to claim 2, wherein the plurality of modular elements comprises a third closed modular element that is configured to close one of the plurality of receiving units.

4. The retaining device according to claim 1, wherein the plurality of receiving units and the outer interface area of the modular elements are hexagonal.

5. The retaining device according to claim 1, wherein two adjacent boundary walls border a peripheral area of the retaining device at an obtuse angle, and wherein the mounting section is arranged in the peripheral area.

6. The retaining device according to claim 5, wherein the two adjacent boundary walls comprise a ligament with a longitudinal axis, and wherein the mounting section is arranged on the longitudinal axis of the ligament.

7. The retaining device according to claim 1, wherein the plurality of receiving units and the outer interface area of the modular elements are rectangular.

8. The retaining device according to claim 1, wherein the modular element is configured to be attached to the frame via a slide that is configured to be fed transversely to the longitudinal axis of the one of the connectors and is configured to engage with the outer interface area.

9. The retaining device according to claim 1, wherein sections of adjacent boundary walls are essentially parallel to one another and form a shared ligament.

10. The retaining device according to claim 1, wherein one of the modular elements comprises a first coding section, wherein one of the plurality of receiving units comprises a second coding section, and wherein the first coding section and the second coding section are configured to mate in such a way that the modular element can be arranged in the receiving unit only in a predetermined orientation.

11. The retaining device according to claim 1, further comprising a blank modular element having a closed face, the blank modular element configured to be received in any of the plurality of receiving units.

12. The retaining device according to claim 1, wherein the outer interface area-further comprises at least one feed element.

13. The retaining device according to claim 11, wherein the outer interface area further comprises alternating feed elements and latches.

14. The retaining device according to claim 1, wherein the outer interface area further comprises a seal, the seal configured to engage with one of the boundary walls when the modular element is received in one of the receiving units.

15. A connector retaining device comprising:

a frame comprising a first receiving unit and a second receiving unit, the first and second receiving units each comprising a stop and a catch;

a plurality of modular elements, the plurality of modular elements comprising:

a first modular element configured to receive a first type of connector;

a second modular element configured to receive a second type of connector that is different than the first type of connector;

the first and second modular elements each comprising an abutment and a latch, wherein each abutment is integral with its respective first and second modular element and each latch is integral with its respective first and second modular element;

the first and second modular elements having a size and shape that corresponds to a size and shape of the first and second receiving units, the first and second modular elements each configured to be received in either of the first and second receiving units;

the connector retaining device configured such that, when the first and second modular elements are received in the first and second receiving units:

the abutments of the first and second modular elements engage with the respective stops of the first and second receiving units; and the latches of the first and second modular elements engage with the respective catches of the first and second receiving units.

16. The retaining device according to claim 15, further comprising a third modular element comprising a closed front face that is not configured to receive a connector.

17. The retaining device according to claim 15, wherein the latches comprise a cantilevered arm with a hook.

18. The retaining device according to claim 15, wherein the first and second retaining units further comprise an inwardly-extending protrusion that comprises the stop on a first surface and the catch on a second surface opposite the first surface.

19. The retaining device according to claim 15, wherein the first and second modular elements each further comprise a first coding section that is configured to engage with a corresponding second coding section of the frame, thereby orientating the first and second modular elements relative to the frame.

20. The retaining device according to claim 15, wherein the first and second modular elements further comprise feed elements on peripheral corners.

21. A retaining device configured to retain and arrange a plurality of connectors, each of the plurality of connectors comprising an insulating section that is configured to hold an electrical contact and that comprises an insulating body, the retaining device comprising:

a frame comprising:

a mounting section configured to connect the retaining device to a wall, the mounting section being arranged in a peripheral area of the retaining device, and a plurality of receiving units, each of the receiving units comprising a boundary wall that bounds a through-hole, the boundary wall comprising an inner wall with a step; and a plurality of modular elements, each one of the plurality of modular elements configured to be received in any of the plurality of receiving units, the modular elements each comprising:

an outer interface area having a flange and a latch, the flange configured to engage with the step when the modular element is received in one of the plurality of receiving units, the latch configured to retain the modular element in one of the plurality of receiving units; and an inner interface area configured to receive one of the plurality of connectors in the modular element;

wherein two adjacent boundary walls border a peripheral area of the retaining device at an obtuse angle, and wherein the mounting section is arranged in the peripheral area.

22. A retaining device configured to retain and arrange a plurality of connectors, each of the plurality of connectors comprising an insulating section that is configured to hold an electrical contact and that comprises an insulating body, the retaining device comprising:

a frame comprising:

a mounting section configured to connect the retaining device to a wall, the mounting section being arranged in a peripheral area of the retaining device, and a plurality of receiving units, each of the receiving units comprising a boundary wall that bounds a through-hole, the boundary wall comprising an inner wall with a step; and a plurality of modular elements, each one of the plurality of modular elements configured to be received in any of the plurality of receiving units, the modular elements each comprising:

an outer interface area having a flange and a latch, the flange configured to engage with the step when the modular element is received in one of the plurality of receiving units, the latch configured to retain the modular element in one of the plurality of receiving units; and an inner interface area configured to receive one of the plurality of connectors in the modular element;

wherein the modular elements are configured to be attached to the frame via a slide that is configured to be fed transversely to the longitudinal axis of the one of the connectors and is configured to engage with the outer interface area.

* * * * *